US010189171B1

(12) United States Patent
Chiang

(10) Patent No.: US 10,189,171 B1
(45) Date of Patent: Jan. 29, 2019

(54) SCISSOR CUTTER

(71) Applicant: I-Wei Chiang, Taichung (TW)

(72) Inventor: I-Wei Chiang, Taichung (TW)

( * ) Notice: Subject to any disclaimer, the term of this patent is extended or adjusted under 35 U.S.C. 154(b) by 0 days.

(21) Appl. No.: 15/653,644

(22) Filed: Jul. 19, 2017

(51) Int. Cl.
*B26B 13/28* (2006.01)
*B26B 13/12* (2006.01)

(52) U.S. Cl.
CPC ..... *B26B 13/28* (2013.01); *B26B 13/12* (2013.01)

(58) Field of Classification Search
CPC ..... B26B 13/28; B26B 13/12
USPC ..... 30/175, 186, 244, 254, 266
See application file for complete search history.

(56) References Cited

U.S. PATENT DOCUMENTS 524,673 A * 8/1894 Bailey
576,937 A * 2/1897 Bailey
1,326,299 A * 12/1919 Wilck ..... B26B 13/00 30/256
1,795,532 A * 3/1931 Wilck ..... A61B 17/2816 30/266
3,404,457 A * 10/1968 Swanstrom, Sr. ..... A61B 17/00 30/267

* cited by examiner

*Primary Examiner* — Hwei-Siu C Payer
(74) *Attorney, Agent, or Firm* — Trop Pruner & Hu, P.C.

(57) ABSTRACT

A scissor cutter includes first and second pivot portions, two first offset portions, two second offset portions, a first cutting portion having a first contact face, and a second cutting portion having a second contact face. The first and second contact faces contact each other along a shear plane. The second pivot portion, the first cutting portion and the first offset portions are located at a first side of the shear plane. The first pivot portion, the second cutting portion and the second offset portions are located at a second side of the shear plane. When the first and second pivot portions pivotally move with respect to each other, the first offset portions respectively abut against the second offset portions.

2 Claims, 9 Drawing Sheets

SCISSOR CUTTER

FIELD

The disclosure relates to a cutter, and more particularly to a scissor-type cutter.

BACKGROUND

A scissor cutter, for example, a gardening cutter, disclosed in Taiwanese Patent No. D110500, or M503083, includes two overlapped cutting members pivotally connect to each other. Generally, the cutting members are prone to wear at their cutting edges and loosen at their pivot point after a period of frequent use. As a result, the scissoring action of the scissor cutter may become ineffective.

SUMMARY

Therefore, an object of the disclosure is to provide a scissor cutter that is capable of balancing abutment pressure about a pivot so as to prevent the pivot from loosening and subjecting to excessive abutment pressure.

According to the disclosure, a scissor cutter includes a first cutting member, a second cutting member, and a pivot.

The first cutting member includes a first pivot portion, two first offset portions, a first cutting portion, and a first handle portion. The first pivot portion is pivotal about a pivot axis of the scissor cutter. The first offset portions are respectively connected to two opposite sides of the first pivot portion, which are opposite from each other along a lengthwise direction of the scissor cutter perpendicular to the pivot axis. The first cutting portion is connected to and extends away from the first pivot portion and one of the first offset portions along the lengthwise direction, and has a first contact face. The first handle portion is connected to the first pivot portion and another one of the first offset portions, and extends oppositely of the first cutting portion.

The second cutting member includes a second pivot portion, two second offset portions, a second cutting portion, and a second handle portion. The second pivot portion is pivotally connected to the first pivot portion. The second offset portions are respectively connected to two opposite sides of the second pivot portion, which are opposite from each other along the lengthwise direction. The second cutting portion is connected to and extends away from the second pivot portion and one of the second offset portions along the lengthwise direction, and has a second contact face. The second handle portion is connected to the second pivot portion and another one of the second offset portions, and extends oppositely of the second cutting portion.

The pivot extends through and interconnects the first and second pivot portions.

The first and second contact faces contact each other along a shear plane. The second pivot portion, the first cutting portion and the first offset portions are located at a first side of the shear plane. The first pivot portion, the second cutting portion and the second offset portions are located on a second side of the shear plane. When the first and second pivot portions pivotally move with respect to each other to perform a scissoring action, the first offset portions respectively abut against the second offset portions.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
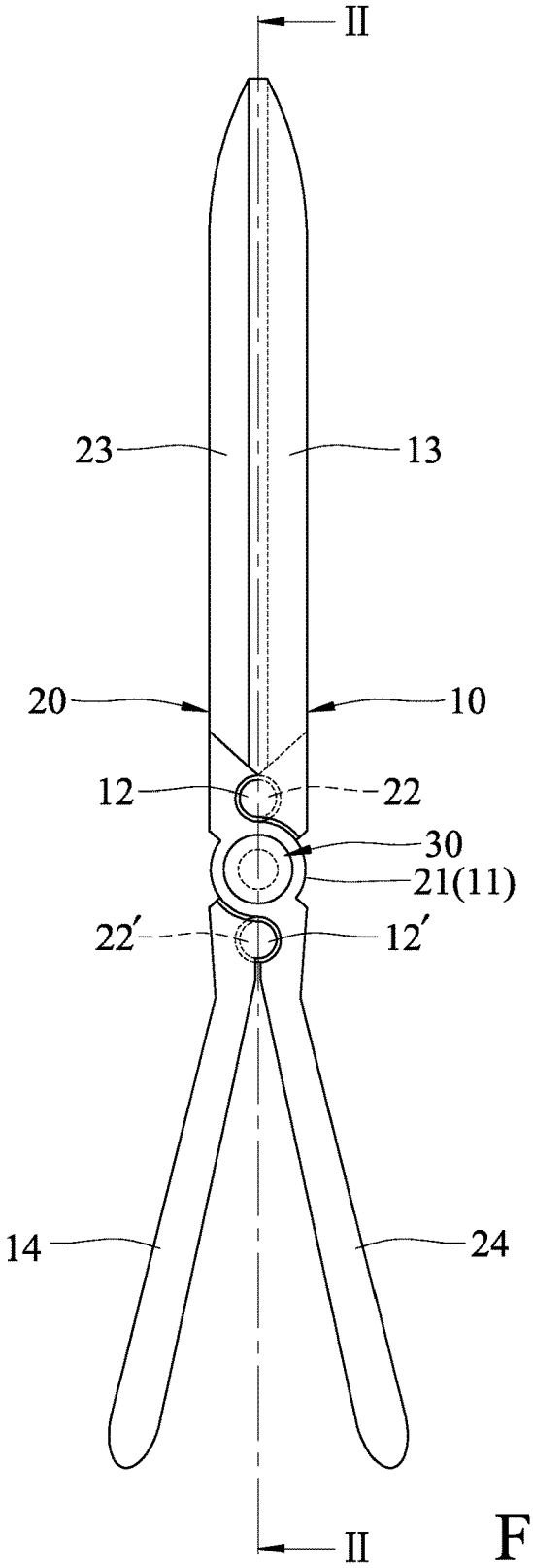
FIG. 1 illustrates a scissor cutter according to a first embodiment of the present disclosure.
Figure 2:
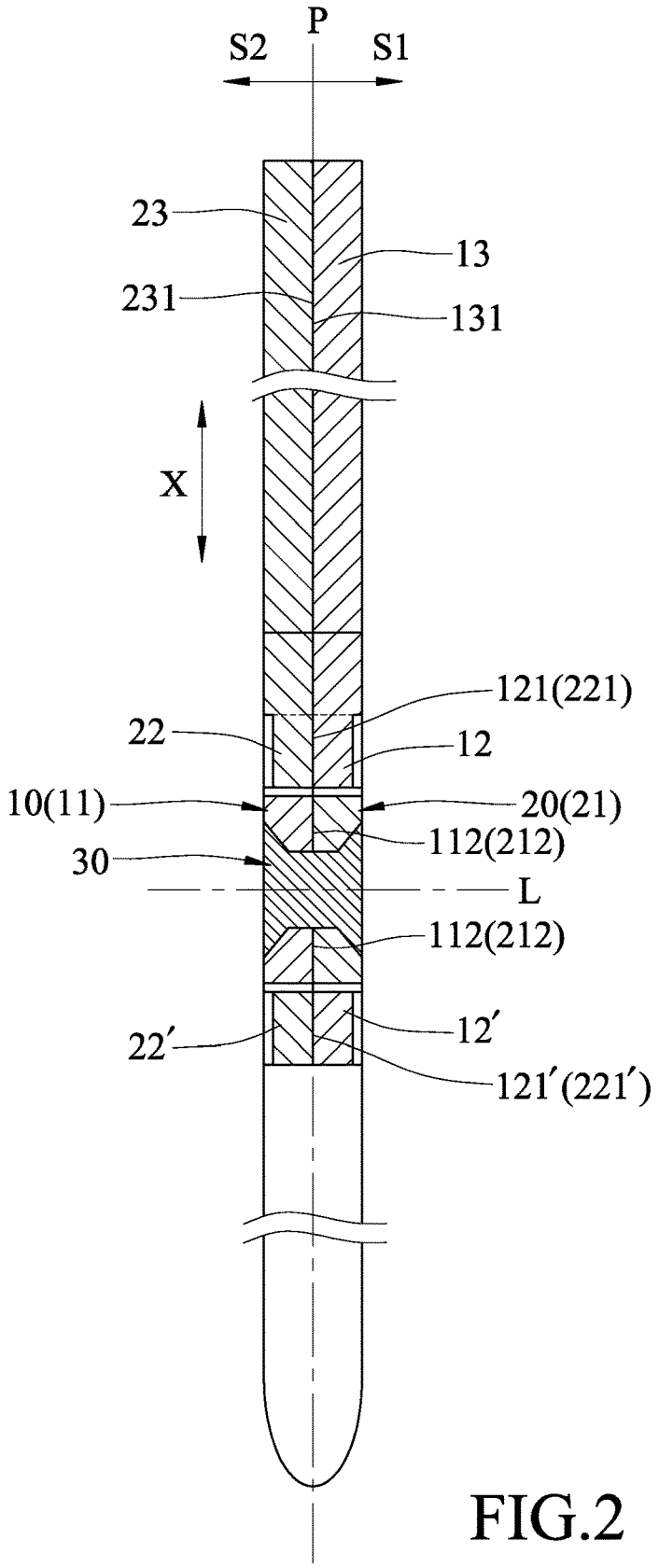
FIG. 2 is a sectional view of the first embodiment taken along line II-II of FIG. 1.
Figure 3:
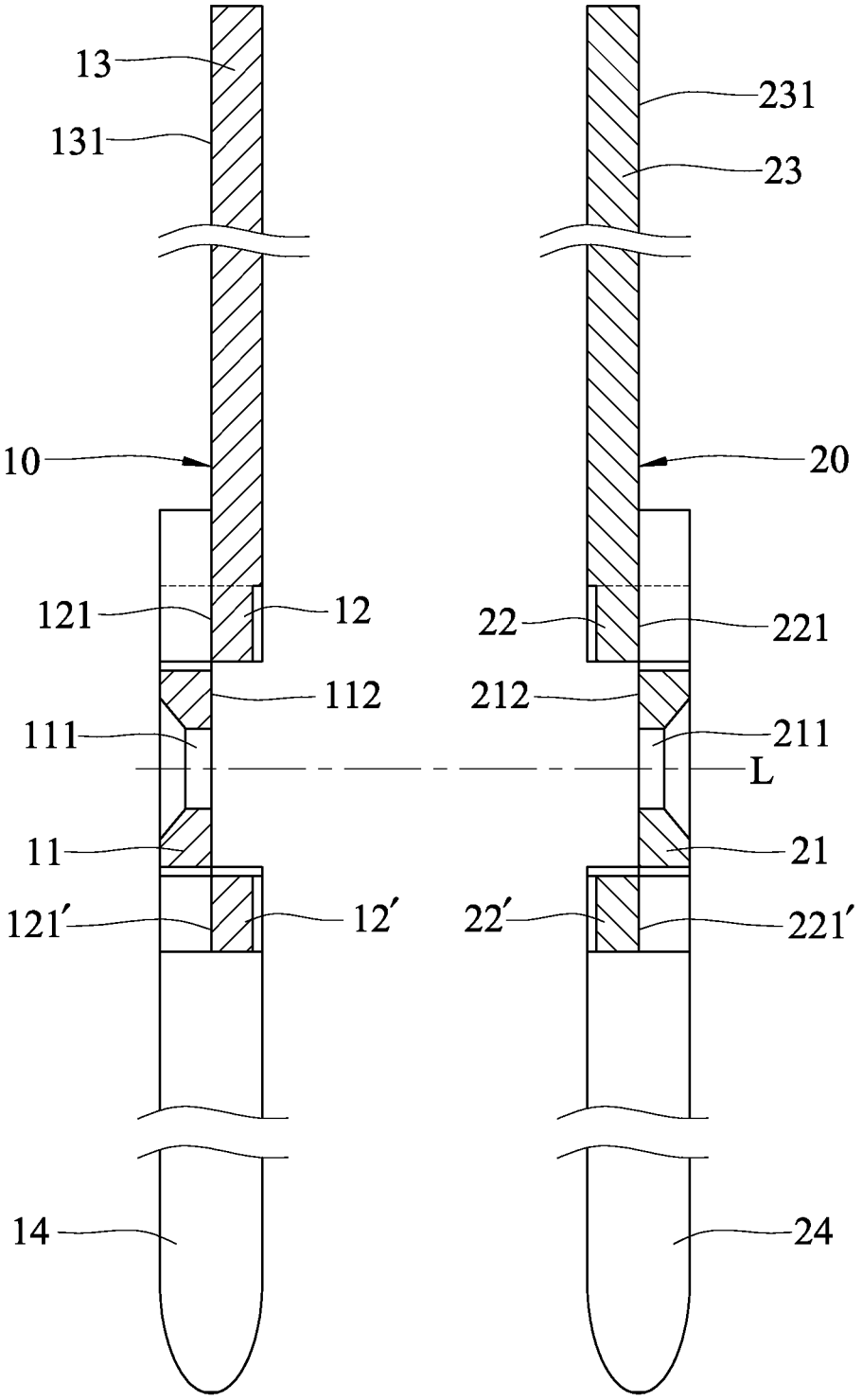
FIG. 3 is an exploded section view of the first embodiment.
Figure 4:
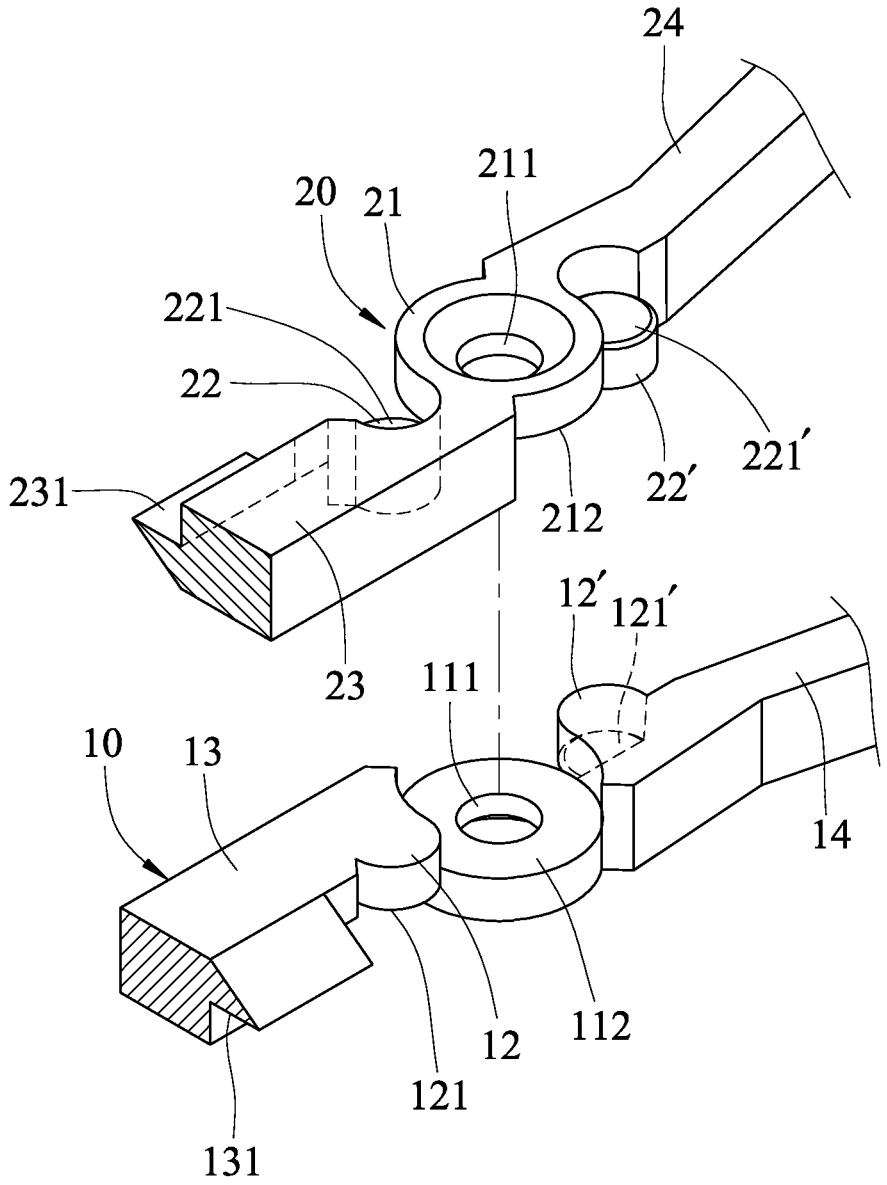
FIG. 4 is a fragmentary exploded view of the first embodiment.

Before the disclosure is described in greater detail, it should be noted that where considered appropriate, reference numerals or terminal portions of reference numerals have been repeated among the figures to indicate corresponding or analogous elements, which may optionally have similar characteristics.

As illustrated in FIGS. 1 to 4, a scissor cutter according to a first embodiment of the present disclosure includes a first cutting member 10, a second cutting member 20, and a pivot 30.

The first cutting member 10 includes a first pivot portion 11, two first offset portions 12, 12', a first cutting portion 13, and a first handle portion 14. The first pivot portion 11 is pivotal about a pivot axis (L) of the scissor cutter. The first offset portions 12, 12' are respectively connected to two opposite sides of the first pivot portion 11, which are opposite to each other with respect to the pivot axis (L) and along a lengthwise direction (X) of the scissor cutter perpendicular to the pivot axis (L). The first cutting portion 13 is connected to the first pivot portion 11 and the first offset portion 12 and extends away therefrom along the lengthwise direction (X). The first handle portion 14 is connected to the first pivot portion 11 and another first offset portions 12', and extends oppositely of the first cutting portion 13. The first pivot portion 11 has a first rotation contact surface 112 transverse to the pivot axis (L), and a first pivot hole 111 extending through the first rotation contact surface 112. Each of the first offset portions 12, 12' has a first balancing surface 121, 121'. The first balancing surfaces 121, 121' of the first offset portions 12, 12' are coplanar with the first rotation contact surface 112. The first cutting portion 13 has a first contact face 131 coplanar with the first balancing surfaces 121, 121' of the first offset portions 12, 12', and the first rotation contact surface 112.

The second cutting member 20 includes a second pivot portion 21, two second offset portions 22, 22', a second cutting portion 23, and a second handle portion 24. The second pivot portion 21 is pivotally connected to the first pivot portion 11. The second offset portions 22, 22' are respectively connected to two opposite sides of the second pivot portion 21, which are opposite to each other along the lengthwise direction (X). The second cutting portion 23 is connected to the second pivot portion 21 and the second offset portions 22 and extends away therefrom along the lengthwise direction (X). The second handle portion 24 is connected to the second pivot portion 21 and another second offset portion 22', and extends oppositely of the second cutting portion 23. The second pivot portion 21 has a second rotation contact surface 212 transverse to the pivot axis (L) and contact the first rotation contact surface 112, and a second pivot hole 211 extending through the second rotation contact surface 212. The second offset portions 22, 22' respectively have second balancing surfaces 221, 221' in contact with respective first balancing surfaces 121, 121' of the first offset portions 12, 12'. The second balancing surfaces 221, 221' of the second offset portions 22, 22' are coplanar with the second rotation contact surface 212. The second cutting portion 23 has a second contact face 231 coplanar with the second balancing surfaces 221, 221' of the second offset portions 22, 22' and is in contact with the first contact face 131.

The pivot 30 extends through the first and second pivotal holes 111, 211 and interconnects the first and second pivot portions 11, 21. In this embodiment, the pivot 30 is a rivet having the pivot axis (L).

Referring back to FIG. 2, the first and second contact faces 131, 231 contact each other along a shear plane (P). The first balancing surfaces 121, 121' respectively contact the second balancing surfaces 221, 221' along the shear plane (P). The first and second rotation contact surfaces 112, 212 contact each other along the shear plane (P). The second pivot portion 21, the first cutting portion 13 and the first offset portions 12, 12' are located at a first side (S1) of the shear plane (P). The first pivot portion 11, the second cutting portion 23 and the second offset portions 22, 22' are located at a second side (S2) of the shear plane (P).

As described above, the second pivot portion 21, the first cutting portion 13 and the first offset portions 12, 12' are located at a first side (S1), and the first offset portions 12, 12' are opposite to each other with respect to the pivot axis (L) and along the lengthwise direction (X). The first pivotal portion 11, the second cutting portion 23 and the second offset portions 22, 22' located at the second side (S2), and the second offset portions 22, 22' are opposite to each other with respect to the pivot axis (L) and along the lengthwise direction (X). During a scissoring operation, the first and second cutting portions 13, 23 engage a work piece (not shown) therebetween, and the first and second pivot portions 11, 21 pivot about the pivot axis (L). The action of scissoring tends to create a displacing force that causes the first and second cutting portions 13, 23 and the first and second pivot portions 11, 21 to displace away from the shear plane (P) along the pivot axis (L). However, because the first offset portions 12, 12' respectively abut against the second offset portions 22, 22', the first and second offset portions 12, 12', 22, 22' apply a counteracting pressure that causes the first and second pivot portions 11, 21 to move toward the shear plane (P) along the pivot axis (L). The counteracting pressure also causes the first cutting portion 13 and the second cutting portion 23 to move toward each other and toward the shear plane (P). Therefore, the first and second pivot portions 11, 21 and the first and second cutting portions 13, 23 are prevented from displacing away from the shear plane (P). An efficient scissoring action may thus be maintained for a long period of use.

Because the first offset portions 12, 12' are opposite to each other with respect to the pivot axis (L) at the first side (S1) and are connected to the first pivot portion 11 at the second side (S2), and because the second offset portions 22, 22' are opposite to each other with respect to the pivot axis (L) at the second side (S2) and are connected to the second pivot portion 21 at the first side (S1), the first and second offset portions 12, 12', 22, 22' are able to provide a uniform counteracting pressure to resist displacement of the first and second pivot portions 11, 21 and the first and second cutting portions 13, 23. Since the counteracting pressure is uniform, localized wear of the first and second cutting portions 13, 23 may be avoided.

In addition, the abutment of the first and second offset portions 12, 12', 22, 22' at the shear plane (P) can share friction force between the first and second pivot portions 11, 21 and between the first and second cutting portions 13, 23, thereby avoiding excessive friction force and maintaining a balanced shearing or scissoring force. The service life of the scissor cutter of the present disclosure may therefore be prolonged. After a long period of use, the first and second cutting portions 13, 23 are not prone to separation at the first and second contact faces 131, 231 and at their ends.

In this embodiment, each of the first and second handle portions 14, 24 has a short straight configuration. Each of the first and second offset portions 12, 12', 22, 22' has, but is not limited to, a semi-circular cross section. The first cutting portion 13 is integrally connected to the first pivot portion 11. The second cutting portion 23 is integrally connected to the second pivotal portion 21. The first and second cutting portions 13, 23 are in the form of a long blade.

Figure 5:
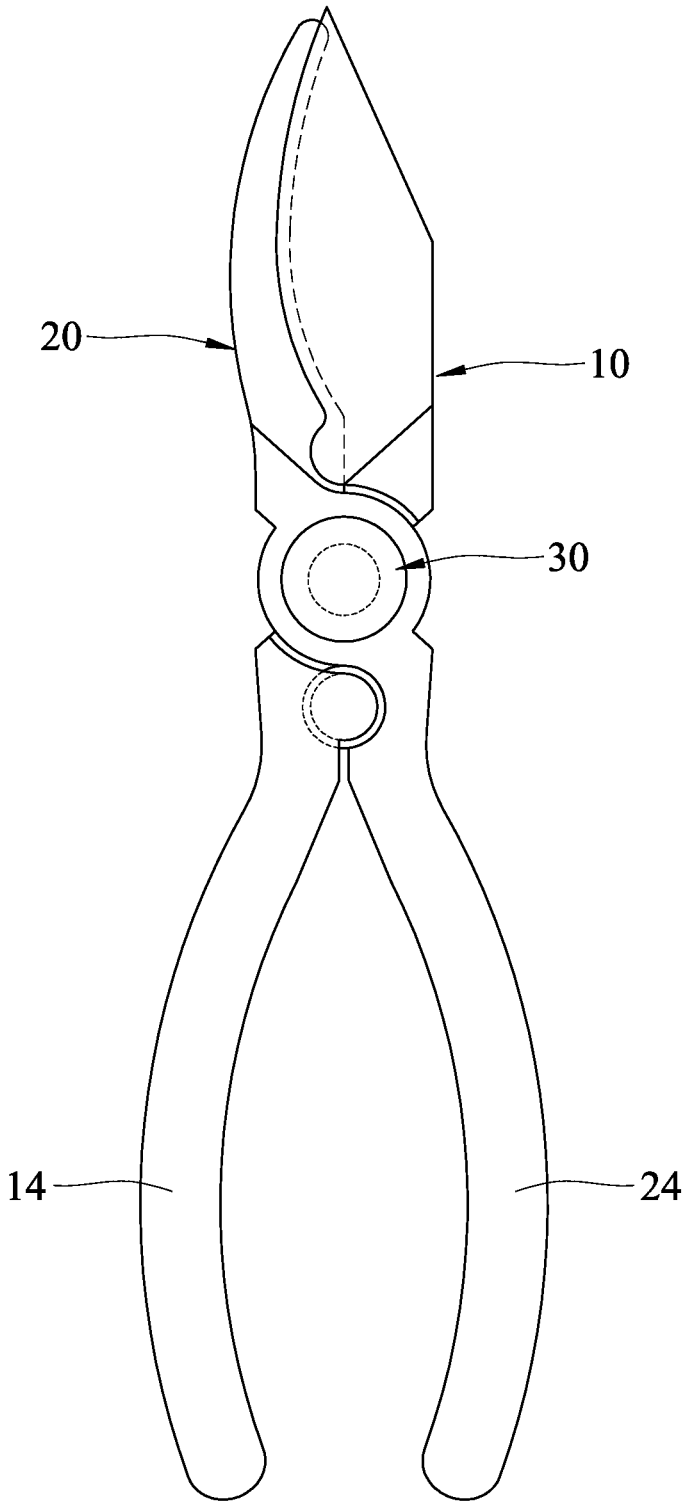
FIG. 5 illustrates a scissor cutter according to a second embodiment of the present disclosure.

Referring to FIG. 5, in a second embodiment of the scissor cutter according to the present disclosure, each of the first and second handle portions 14, 24 is curved. The first and second cutting portions 13, 23 are curved.

Figure 6:
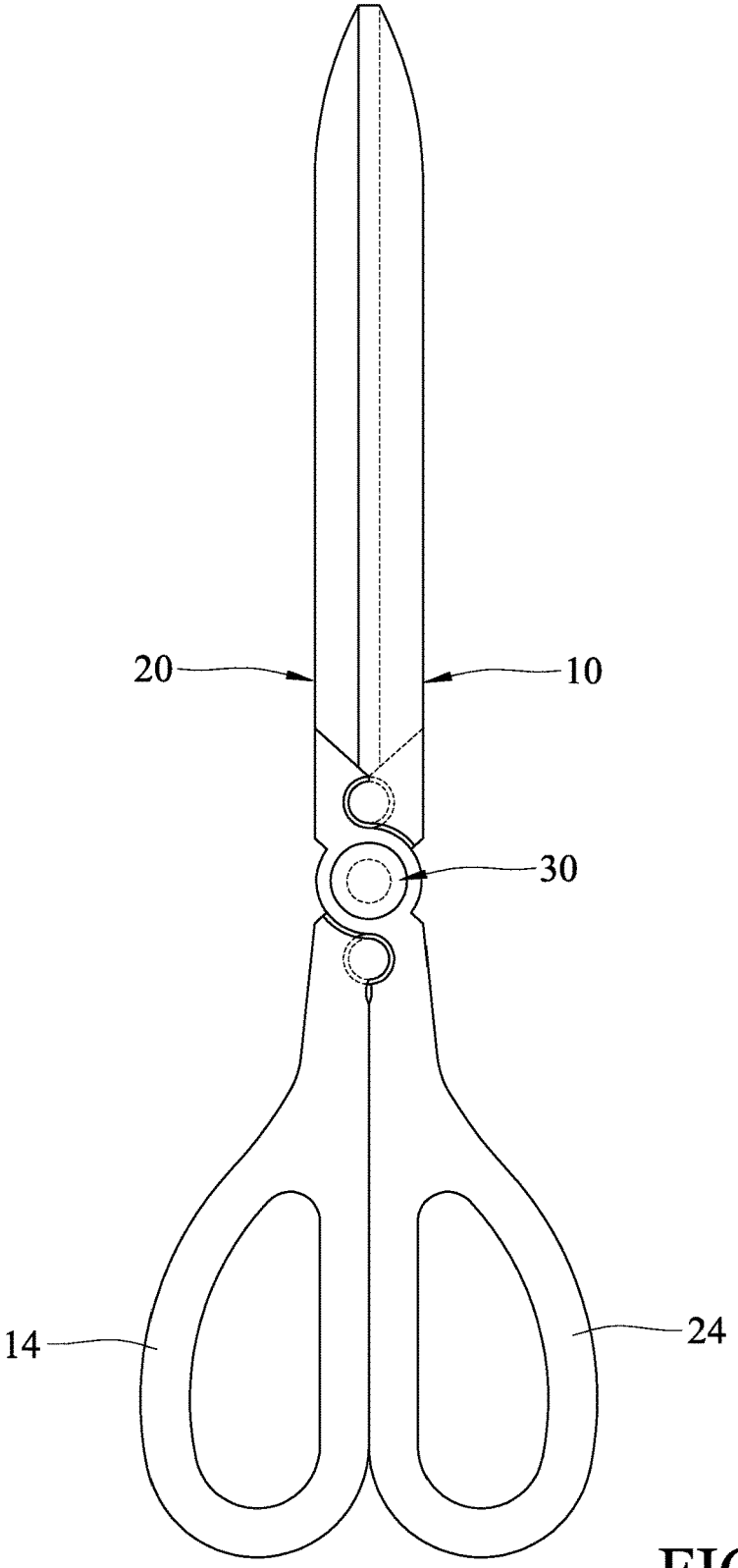
FIG. 6 illustrates a scissor cutter according to a third embodiment of the present disclosure.

Referring to FIG. 6, in a third embodiment of the scissor cutter according to the present disclosure, the difference from the first embodiment resides in that each of the first and second handle portions 14, 24 has an elliptical ring shape.

Figure 7:
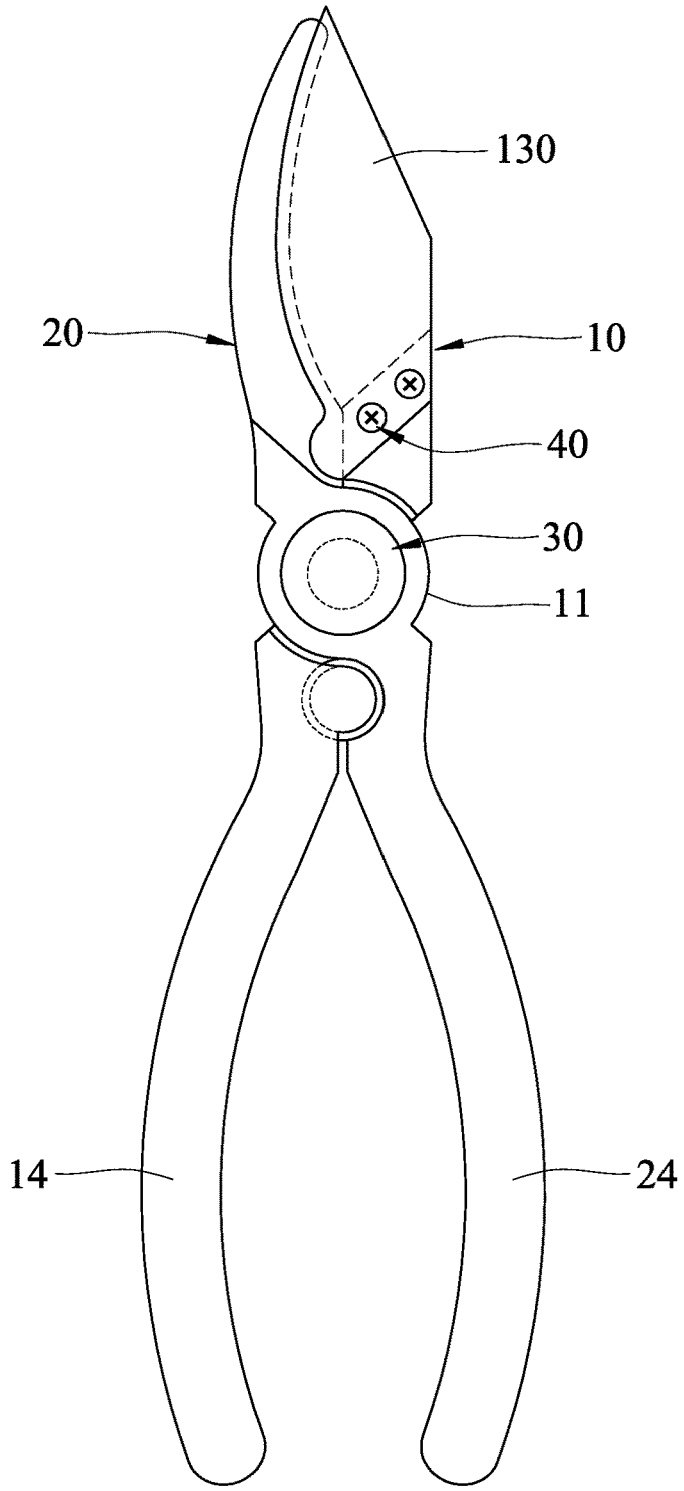
FIG. 7 illustrates a scissor cutter according to a fourth embodiment of the present disclosure.

Referring to FIG. 7, in a fourth embodiment of the scissor cutter according to the present disclosure, the first cutting portion 130 is detachably screwed to the first pivot portion 11 using a plurality of screws 40. The first cutting portion 130 may be detached from the first pivot portion 11 for replacement and sharpening cutting edges thereof when necessary.

Figure 8:
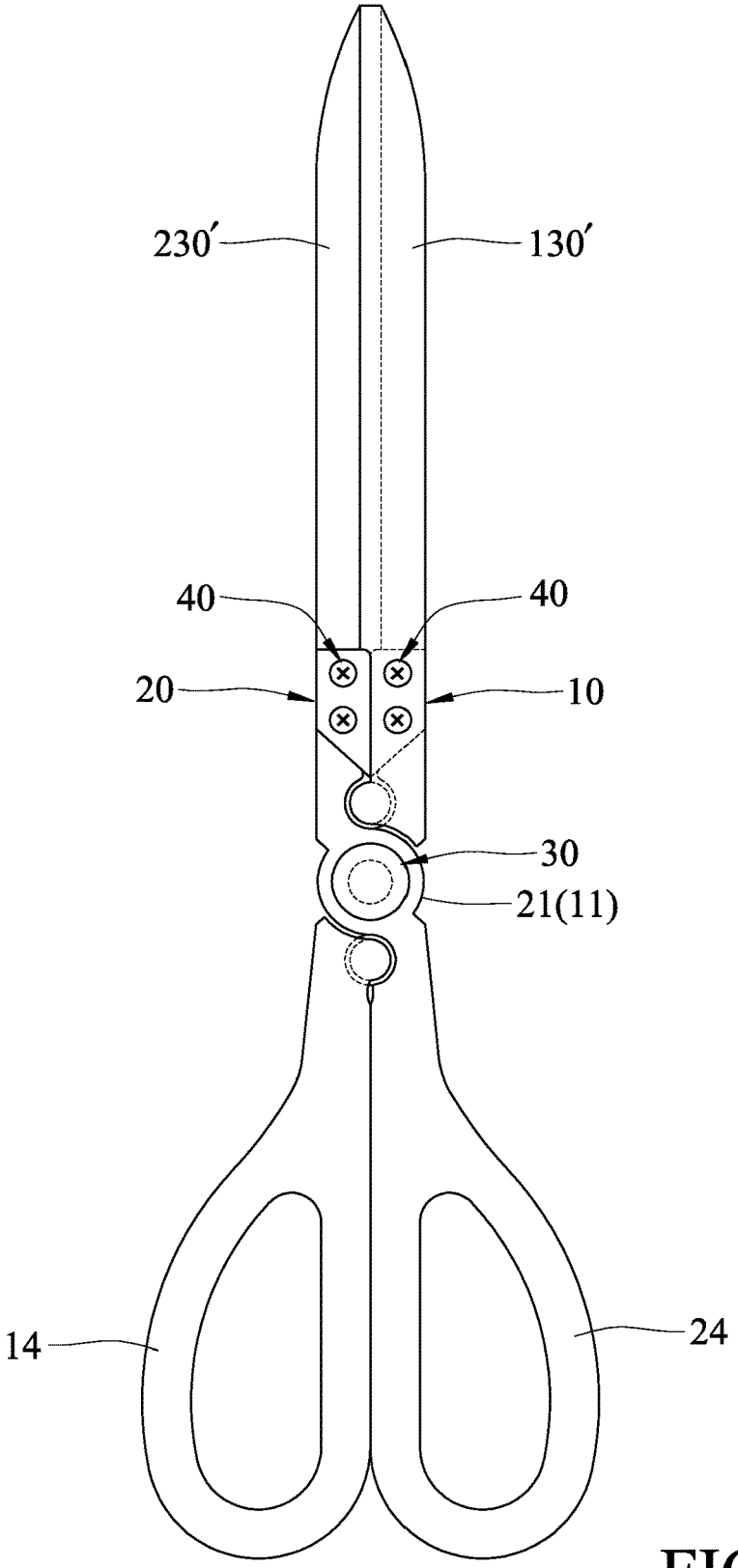
FIG. 8 illustrates a scissor cutter according to a fifth embodiment of the present disclosure.
Figure 9:
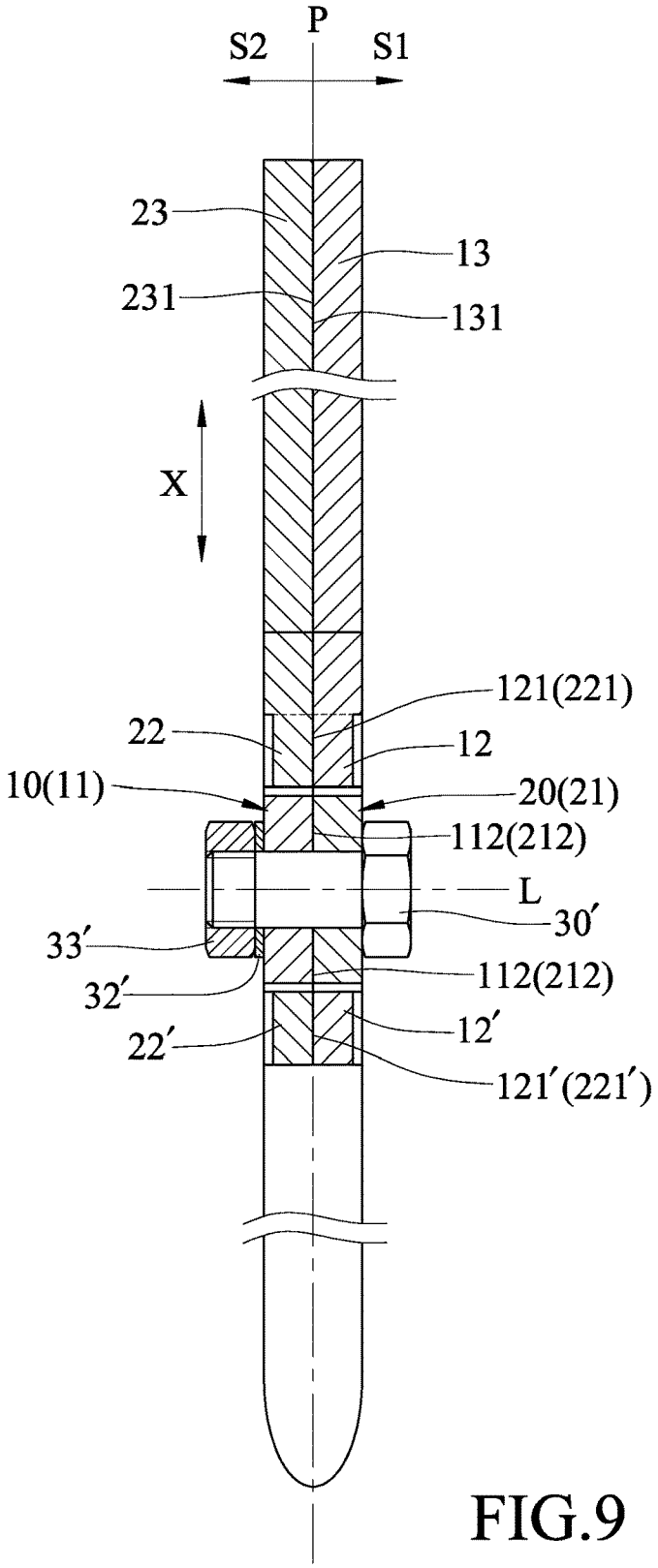
FIG. 9 illustrates a scissor cutter according to a sixth embodiment of the present disclosure.

Referring to FIG. 8, in a fifth embodiment of a scissor cutter according to the present disclosure, the first and second cutting portions 130', 230 are detachably and respectively screwed to the first and second pivot portions 11, 21 with screws 40 so that the first and second cutting portion 130', 230' may be detached when necessary.

Referring to FIG. 8, in a sixth embodiment of a scissor cutter according to the present disclosure, the pivot 30' is a bolt extending through the first and second pivot portion 11, 21. A washer 32' is sleeved on the pivot 30', and a nut 33' is secured the pivot 30'.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A scissor cutter, comprising:

a first cutting member including a first pivot portion pivotal about a pivot axis of said scissor cutter, two first offset portions respectively connected to two opposite sides of said first pivot portion, which are opposite to each other with respect to the pivot axis and along a lengthwise direction of the scissor cutter perpendicular to the pivot axis, a first cutting portion that is connected to said first pivot portion and one of said first offset portions and extends away therefrom along the lengthwise direction and that has a first contact face, and a first handle portion that is connected to said first pivot portion and the other of said first offset portions and that extends oppositely of said first cutting portion;

a second cutting member including a second pivot portion pivotally connected to said first pivot portion, two second offset portions respectively connected to two opposite sides of said second pivot portion, which are opposite to each other with respect to the pivot axis and along the lengthwise direction, a second cutting portion that is connected to said second pivot portion and one of said second offset portions and extends away therefrom along the lengthwise direction and that has a second contact face, and a second handle portion that is connected to said second pivot portion and the other of said second offset portions and that extends oppositely of said second cutting portion; and a pivot extending through and interconnecting said first and second pivot portions;

wherein said first and second contact faces contact each other along a shear plane, said second pivot portion, said first cutting portion and said first offset portions are located at a first side of the shear plane, and said first pivot portion, said second cutting portion and said second offset portions are located at a second side of the shear plane, and wherein, when said first and second pivot portions pivotally move with respect to each other, said first offset portions respectively abut against said second offset portions along said shear plane.

2. The scissor cutter as claimed in claim 1, wherein:

said first pivot portion has a first rotation contact surface transverse to the pivot axis, and a first pivot hole extending through said first rotation contact surface and allowing insertion of said pivot;

each of said first offset portions has a first balancing surface, said first balancing surfaces of said first offset portions being coplanar with said first rotation contact surface along the shear plane, said first offset portions being located at the first side of the shear plane, said first pivot portion being located at the second side of the shear plane;

said second pivot portion has a second rotation contact surface transverse to the pivot axis and in contact with said first rotation contact surface, and a second pivot hole extending through said second rotation contact surface and allowing insertion of said pivot; and each of said second offset portions has a second balancing surface in contact with said first balancing surface of one of said first offset portions along the shear plane, said second balancing surfaces of said second offset portions being coplanar with said second rotation contact surface along the shear plane, said second offset portions being located at the second side of the shear plane, said second pivot portion being located at the first side of the shear plane.

* * * * *